United States Patent [19]

Miyazaki

[11] 4,451,315

[45] May 29, 1984

[54] PROCESS FOR PRODUCING A NON-WOVEN FABRIC

[75] Inventor: Tadashi Miyazaki, Ibaragi, Japan

[73] Assignee: Firma Carl Freudenberg, Weinheim an der Bergstrasse, Fed. Rep. of Germany

[21] Appl. No.: 434,475

[22] Filed: Oct. 15, 1982

[30] Foreign Application Priority Data

Nov. 20, 1981 [JP] Japan ..... 56-187495

[51] Int. Cl.[3] ..... B31F 23/10

[52] U.S. Cl. ..... 156/220; 156/154; 156/221; 156/277; 427/381; 427/389; 427/389.9; 428/195; 428/290

[58] Field of Search ..... 156/220, 277, 154, 291, 156/221; 427/381, 389, 389.9; 428/195, 290

[56] References Cited

U.S. PATENT DOCUMENTS 4,119,746 10/1978 Bleyle ..... 428/290

4,170,680 10/1979 Cumbers ..... 428/195

*Primary Examiner*—Edward C. Kimlin

*Assistant Examiner*—Timothy W. Heitbrink

*Attorney, Agent, or Firm*—Kenyon & Kenyon

[57] ABSTRACT

This application discloses a process for producing a non-woven fabric which comprises applying a crosslinkable bonding agent to a portion of the surface of a fiber assembly, applying heat and pressure to drive the crosslinkable bonding agent into the fiber assembly and to densify the fiber assembly and subsequently crosslink the bonding agent.

18 Claims, No Drawings

PROCESS FOR PRODUCING A NON-WOVEN FABRIC

FIELD OF THE INVENTION

The present invention relates to a process for preparing a non-woven fabric having good pliability and durability.

BACKGROUND OF THE INVENTION

In the past partially bonded non-woven fabrics have been prepared by applying a bonding medium to fiber webs in a mere spot pattern, the fiber webs being then subjected to drying and heat treatment. However, since the bonding medium is applied to the surface of the fiber webs, it does not sufficiently penetrate into the interior of the web. Therefore, the back side of the fiber web is not adequately bonded fiber to fiber, and accordingly it is always possible for the back side of the fibrous web to become hairy. As such, partially bonded non-woven fabrics have been accorded very low ratings during pill tests. Various methods of overcoming this difficulty have been employed, particularly where thick fibrous webs are employed, where it is quite difficult to obtain sufficient penetration of the bonding agent. Such methods include increasing the quantity of the bonding agent which is applied to the web, reducing bonding agent concentration, increasing the area of bond, and applying the bonding agent from the back side as well as from the top surface of the fibrous web. However, these methods have all been found disadvantageous since the non-woven fabric produced is adversely affected with respect to pliability, or the process is rendered overly complicated. Further, no significant improvement in durability has resulted from these processes.

BRIEF DESCRIPTION OF THE PRESENT INVENTION

The present invention provides a process for producing a non-woven fabric which comprises applying a crosslinkable bonding agent to a portion of the surface of a fiber assembly, applying heat and pressure to drive the crosslinkable bonding agent into the fiber assembly and to densify the fiber assembly, and subsequently crosslinking the crosslinkable bonding agent by a heat treatment.

DETAILED DESCRIPTION OF THE INVENTION

In accordance with the invention, crosslinkable bonding agent is applied to portions of a fiber assembly, and the same is driven into the fiber assembly by the action of heat and pressure, and concurrently the fiber assembly is densified. The fiber assembly becomes thinner and is highly densified, so that the portions thereof to which the bonding agent has been applied, and their peripheral areas, are adequately bonded fiber to fiber in the direction of thickness. Subsequently, the crosslinkable bonding agent is crosslinked through a heat treatment. As a result, the portions of the fiber assembly to which the bonding agent has been applied have increased strength because of the crosslinking resulting from the heat treatment, while the portions of the fiber assembly to which bonding agent has not been applied have increased bulkiness among the individual fibers, and regain the original thickness of the fiber assembly. Therefore, the partially bonded non-woven fabric, thus obtained, is such that the bonded portions are small and of high density, whereas the non-bonded portions are bulky in fiber-to-fiber relation, much less flex resistant, and of very soft hand.

The fiber assembly may be comprised of any one of a number of fibers including synthetic fibers such as polyester and polyamide, regenerated fibers such as rayon and the like, and natural fibers such as cotton and the like. The fiber assembly can be comprised of one fiber type, or mixtures of one or more different fibers. However, from the viewpoint of wear resistance, crimp tendency, or elastic recovery, synthetic fibers are particularly preferable.

Fiber assemblies may be produced by carding or air laying, using any known dry-web forming machine. It is also possible to produce fiber assemblies directly from resin by employing direct spinning equipment. Fiber assemblies may be pretreated in such a way that the constituent fibers are interlocked by needling. In the case of fiber assemblies of bulky synthetic fiber such as polyester or the like, it is desirable that the fiber assembly be precompacted by hot-rolling for thickness reduction.

Among the preferred crosslinkable bonding agents are self-crosslinkable acrylic ester, self-crosslinkable ethylenevinyl acetate copolymers, and self-crosslinkable synthetic rubbers such as SBR and NBR. Of course, bonding agents of the type which require the use of a crosslinkable agent in combination therewith may be used.

To apply a crosslinkable bonding agent to portions of the fiber assembly, generally a paste of an emulsion or the like of the bonding agent is applied directly to portions of the surface of the fiber assembly by means of a rotary screen printing machine. Then, the fiber assembly is preferably dried in a dryer at a temperature as low as about 80° C. for about 5 min. in order to remove moisture therefrom, taking care that the crosslinking reaction does not take place.

However, in order to equalize the amount of the bonding agent applied, it is preferable that after the bonding agent is applied to a releasable rubber sheet or releasable drum, moisture is allowed to evaporate therefrom, if the circumstance requires, and then the bonding agent is transferred from the sheet or drum to the surface of the fiber assembly. By such transfer it is possible to prevent the pattern of the bonding medium from spreading and, thereby to obtain a clear and uniform pattern of the bonding medium on the surface of the fiber assembly. The non-woven fabric thus produced, as compared with a similar fabric to which the bonding agent is directly applied, has a softer hand, and is relatively free from such phenomena as run or bleeding of the pattern. Then, heat and pressure are applied to drive the crosslinkable bonding agent into the fiber assembly and to densify the fiber assembly.

The crosslinkable bonding agent is successfully driven into the fiber assembly at temperatures of 150° to 250° C., and under pressures of 50 kg/cm$^2$ or less by employing a calendering machine comprising steel rolls and cotton rolls, the bonded portions of the surface of the fiber assembly being thus densified. With this densification process, the bonding agent which has been applied to portions of the surface of the fiber assembly, completely penetrates the fiber assembly to the back surface thereof. The portions of the fiber assembly to which bonding agent has been applied were found to be thin, and to have been highly densified.

Subsequent heat treatment results in crosslinking of the crosslinkable bonding agent, so that the intrinsic properties of the bonding agent, such as bond strength, wash resistance, and dry cleanability, are adequately reflected in the densified portions of the treated fiber assembly. If the bonding agent is allowed to crosslink at the calendering stage, heat treatment can do little to allow those portions to which the bonding agent has not been applied to regain their original thickness, and as a consequence, the resulting non-woven fabric, as a whole, will be substantially high fiber density and of hard hand. According to the invention, non-bonded portions securely held by partially densified, thin bonded portions, regain the original thickness of the fiber assembly and, accordingly, their resistance to bending is very insignificant. Thus, it is possible to obtain a non-woven fabric having a very soft hand. Since the bonded portions are densified, the fabric is not subject to stains and exhibits very high resistance to restaining during washing or dry cleaning.

Furthermore, since the bonded portions are of high density and are strongly bound, it is possible to process the non-woven fabric by buffing into one having a unique hairy structure and appearance, and having a soft hand.

The invention will be illustrated further with reference to the following examples.

EXAMPLE 1

A 30 g/m$^2$ fiber assembly of polyester fiber, 1 denier, 38 mm cut was compressed by passing it through a steel calendering machine at 150° C. under the following conditions: slit width 0.05 mm, nip pressure 30 kg/cm. The compressed fiber assembly compressed in this manner was apparently integral, but was such that it could return to its original state if pulled somewhat vigorously by hand. To this fiber assembly a medium bonding paste of self-crosslinking acrylic ester emulsion was applied by means of a rotary screen printing machine. The bonding medium had a 40% concentration, and had a viscosity of 15,000 cps. The screen for applying the bonding medium was of zigzag arranged rectangular pattern, each rectangle being 0.9×0.6 mm in size. The bonding medium covered a 15% area of the surface of the fiber assembly and had a dry weight of 13 g/m$^2$. The fiber assembly to which the bonding medium was applied as it was in swollen state was dried in a dryer at 80° C. for about 5 min., its moisture content being removed with care so that the crosslinking reaction would not take place.

Next, the treated fiber assembly was fed through a calendering machine having steel rolls and cotton rolls at 190° C., and under a pressure of 30 kg/cm$^2$, whereby the crosslinkable bonding medium was driven into the fiber assembly, and densified. The bonding medium completely penetrated the fiber assembly to the back thereof and was found to be in the form of a dense film. Subsequently, the fiber assembly was subjected to heat treatment at 150° C. for about 5 min. Upon completion of the crosslinking of the bonding agent, the unbonded portions of the product regained their original thickness.

The non-woven fabric thus obtained was found to possess good pliability, a firmly bonded uneven appearance, high wash resistance, and good dry cleanability.

EXAMPLE 2

A bonding agent of self-crosslinking ester emulsion was applied to a 70 g/m$^2$ fiber assembly of pill-resistant type polyester fiber, 1.5 denier, 51 mm cut in the same manner as Example 1. The bonding agent had a 49% concentration, and had a viscosity of 15,000 cps.

The screen employed for applying the bonding agent had a zigzag arranged rectangular pattern, each rectangle being of 2.5×0.4 mm size; the bonding agent covered a 15% area and had a dry weight of 30 g/m$^2$.

Similarly to Example 1, the fiber assembly was subjected to moisture removal at 80° C., and then to calendering at 190° C. under a pressure of 40 kg/cm. Next, the heat treatment was undertaken at 150° C. for about 10 min. As a result, a highly pliable non-woven fabric having a very distinct unevenness between the bonded and unbonded parts was obtained. The non-woven fabric was subsequently subjected to buffing with No. 240 sand paper. The result was a product having good patterned hair arrangement, with fine appearance and hand.

EXAMPLE 3

A bonding paste print of self-crosslinking acrylic ester emulsion was applied onto a releasable silicone-rubber conveyor belt. The concentration and viscosity of the bonding medium, screen pattern, bond area and dry weight of the bonding medium was the same as in Example 2. Moisture was completely removed from the bonding paste print by using a dryer at 80° C., with care that the crosslinking reaction would not take place. Next a 70 g/m$^2$ fiber assembly of rayon staple, 1.5 denier and 51 mm cut, was placed on the conveyor belt, and pressed down lightly with a steel roll at 100° C. under a pressure of 3 kg/cm, so that the paste was completely transferred onto the fiber assembly.

Subsequently, the fiber assembly was subjected to calendering, then to heat treatment at 150° C., in the same manner as described in Example 1. As a result, a firmly bonded non-woven fabric was obtained. The non-woven fabric, which possessed good water-absorptive properties and high durability, was found suitable for use as wiping cloth.

While certain representative embodiments of the invention have been discussed herein for purposes of illustration, it will be apparent to those of skill in the art that modifications may be made therein without departing from the spirit and scope of the invention.

I claim:

1. A process for preparing a pliable and durable non-woven fabric comprising:

a. printing a crosslinkable bonding agent in a patterned fashion onto one surface of a non-woven fiber assembly, b. applying heat and pressure to the fiber assembly sufficient to cause the bonding agent on the surface of the fiber assembly to penetrate through the fiber assembly to the surface of the fiber assembly opposite to the surface to which the bonding agent was originally applied thereby densifying portions of the fiber assembly, said heat and pressure being insufficient to crosslink the bonding agent, and c. applying heat to the fiber assembly sufficient to crosslink the bonding agent and to provide a pliable non-woven fabric having a distinct unevenness between the bonded and unbonded parts, wherein the areas of fiber assembly to which bonding agent has not been applied have a thickness about equal to the original thickness of the fiber assembly.

2. The method according to claim 1 wherein said fiber assembly comprises a fibrous web of synthetic fibers.

3. The method according to claim 1 wherein said crosslinkable bonding agent is selected from the group consisting of self-crosslinkable acrylic ester, self-crosslinkable acetate copolymer, and self-crosslinkable SBR or NBR rubber.

4. The method according to claim 1 wherein the crosslinkable bonding agent is applied to the fiber assembly by means of a rotary screen printing machine.

5. The method according to claim 4 wherein the crosslinkable bonding agent is in the form of a paste and after application to the fiber assembly is subjected to heat sufficient to remove the moisture from said paste, but insufficient to crosslink the bonding agent.

6. The method according to claim 1 wherein the crosslinkable bonding agent is applied in the form of a paste of an emulsion of the bonding agent, to the surface of a sheet or drum, moisture is removed from said paste, and then said paste is transferred from the surface of the sheet to the fiber assembly.

7. The method according to claim 5 or claim 6 wherein said fiber assembly to which said bonding agent has been applied is subjected to heat of about 150° to about 250° C. and a pressure of less than about 50 $kg/cm^2$, to drive said bonding agent into said fiber assembly and to densify the fiber assembly.

8. The method according to claim 3 wherein the fiber assembly is comprised of polyethylene or rayon fibers.

9. The method according to claims 5 or 6 wherein the crosslinkable bonding agent is applied to about 15% of the surface of the fiber assembly, and comprised a paste of self-crosslinkable acrylic ester emulsion.

10. The method according to claim 6 wherein a paste of a self-crosslinkable acrylic ester emulsion having a viscosity of about 15,000 cps is printed onto about a 30 to about a 70 $g/m^2$ assembly of polyester fibers of about 1 to 1.5 denier and about 38 to about 51 mm cut, such that the paste covers about 15% of the surface of the fiber assembly and has a dry weight of about 13 $g/m^2$ to about 30 $g/m^2$, said fiber assembly having been compacted by hot-rolling prior to the application of said paste.

11. The method according to claim 10 further comprising the step of buffing the surface of the product of said process to provide a hairy structure and appearance.

12. The method according to claim 6 wherein the sheet comprises a silicone rubber conveyor belt.

13. The method according to claim 12 wherein the fiber assembly is comprised of about a 70 $g/m^2$ assembly of rayon fibers, and the crosslinkable bonding agent comprises a paste of a self-crosslinking acrylic ester emulsion which is printed onto the conveyor belt.

14. The process according to claim 1 wherein the bonding agent is caused to penetrate the fiber assembly by passing the bonding agent treated fiber assembly through calender rollers which apply a pressure of 50 $Kg/cm^3$ or less and a temperature of about 150° C. to about 250° C. to the fiber assembly.

15. The process according to claim 1 further comprising the step of compressing the fiber assembly prior to the application of the crosslinkable bonding agent, and then printing the bonding agent onto said portions of the surface of the fiber assembly.

16. The process according to claim 1 wherein the fiber assembly is comprised of polyester fibers.

17. The process according to claim 16 wherein the bonding agent comprises a self-crosslinking acrylic ester emulsion.

18. The process according to claim 1 wherein the bonding agent comprises a self-crosslinking acrylic ester emulsion.

* * * * *

UNITED STATES PATENT AND TRADEMARK OFFICE

CERTIFICATE OF CORRECTION

PATENT NO. : 4,451,315

DATED : May 29, 1984

INVENTOR(S) : TADASHI MIYAZAKI

It is certified that error appears in the above-identified patent and that said Letters Patent is hereby corrected as shown below:

In column 4, line 40 change "...as described in Example 1." to read --...as described in Example 2.--

In column 5, line 37, claim 10, change "...according to claim 6..." to read --...according to claim 5...--

Signed and Sealed this

Second Day of October 1984

[SEAL]

*Attest:*

GERALD J. MOSSINGHOFF

*Attesting Officer*

*Commissioner of Patents and Trademarks*